US005104244A

United States Patent [19]

Eldred et al.

[11] Patent Number: 5,104,244

[45] Date of Patent: Apr. 14, 1992

[54] PRINTER THROAT CONTROL MECHANISM

[75] Inventors: Bruce P. Eldred, Endicott; Floyd A. Gregory, Binghamton, both of N.Y.

[73] Assignee: International Business Machines Corp., Armonk, N.Y.

[21] Appl. No.: 662,685

[22] Filed: Mar. 1, 1991

[51] Int. Cl.[5] ..... B41J 11/20

[52] U.S. Cl. ..... 400/56; 400/649

[58] Field of Search ..... 400/56, 57, 58, 59, 400/649, 653

[56] References Cited

U.S. PATENT DOCUMENTS

| | | | |
|---|---|---|---|
| 3,155,032 | 11/1964 | Antonucci | 101/45 |
| 4,210,076 | 7/1980 | Yamamura et al. | 101/111 |
| 4,248,146 | 2/1981 | Miyasaka et al. | 101/93.03 |
| 4,280,007 | 10/1988 | Weeks et al. | 400/56 |
| 4,420,269 | 12/1983 | Acuermann et al. | 400/356 |
| 4,575,267 | 3/1986 | Brull | 400/656 |
| 4,773,772 | 9/1988 | Hanna et al. | 400/58 |
| 4,848,945 | 7/1989 | Sone | 400/649 |
| 4,932,797 | 6/1990 | Emenaker et al. | 400/56 |

OTHER PUBLICATIONS

"Forms Sensor for Automatic Platen", IBM Tech. Discl. Bulletin, vol. 13, No. 12, May 1971, p. 3643.

"Constant Free-Flight Adjustable Platen for Impact Printer", IBM Tech. Discl. Bulletin, vol. 14, No. 7, Dec. 1971, pp. 2193-2194.

"Automatic Adjusting Document Validation Station", IBM Tech. Discl. Bulletin, vol. 24, No. 11B, Apr. 1982, pp. 6158-6159.

*Primary Examiner*—Eugene H. Eickholt

*Attorney, Agent, or Firm*—John S. Gasper

[57] ABSTRACT

A printer has first and second print mechanisms separated by a gap for the passage of a print medium. The print mechanisms are mounted on relatively movable support members. A gap adjustment mechanisms has one set of cam means for moving the support members relative to each other for both forms loading and forms thickness adjusting. The cam means comprises a pair of elongate cam bars translatable along one support member and follower pins on the other member which are located in camming slots formed in the cam bars. The camming slots have first and second camming sections in the form of linear ramps with gentle and steep slope angles respectively. The cam bars are translatable by pinion gearing in engagement with rack gearing on the cam bars, the pinion gears being on a shaft rotatable by a knob to thereby cause the follower pins to be cammed by either the first linear ramp for forms thickness adjustment or the second linear ramp for forms loading.

13 Claims, 4 Drawing Sheets 11
13
18a
18b
36
36e
36d''
36d'
24
34
10
40
39
36b
20
22
28
18
32
36d'''

PRINTER THROAT CONTROL MECHANISM

FIELD OF THE INVENTION

This invention relates to printing machines and more particularly to printers having a mechanism for controlling the paper gap, sometimes called the throat, of a printer. The invention relates especially to a gap adjustment mechanism having utility in a line printer and is designed to be manually operated although not necessarily so limited.

BACKGROUND OF THE INVENTION

It is common in printers to have means to change the size of the paper gap between cooperating elements of the print mechanism, such cooperating print elements being either print hammers and a type carrier, such as an engraved band or drum, of high speed impact line printers or the print head, wheel or other impression forming elements and the platen of serial type printers. The reason for changing the gap is for printing on a medium, such as a paper web, having different thicknesses. In high speed printers, it is desirable to be able to adjust the gap in a manner such that distance between the print hammers, for example, and the paper is constant regardless of the thickness of the paper. Basically, gap adjustment to accommodate variations in paper thickness is a fine adjustment more or less precise. Another common form of gap adjustment is one in which the gap is merely opened or enlarged to the degree that the print medium, irrespective of thickness, can be conveniently installed or removed from the printer. Enlarging the gap to enable installation of the print medium is basically a gross or coarse change. Ordinarily, the fine and coarse gap adjustments were accomplished through separate mechanisms. As a consequence, the gap changing mechanisms have tended to be complex thereby adding to the cost of construction and operation of the printing machines.

For example, the cooperating print elements, such as print hammers and type carrier of a line printer, are conventionally mounted facing each other on separate support structures or frames which are relatively movable. The means for adjusting the paper gap between the cooperating print elements to accommodate paper of different thicknesses comprises cam means on a rotatable shaft manually rotated by a lever to cause relative movement of the frames. The means for opening the gap comprises a handle on the one frame, commonly called the swing frame, which is connected by a horizontal or vertical hinge structure to the other frame. An early example of this arrangement is shown in U.S. Pat. No. 3,155,032. Later examples of such gap changing mechanisms are found in U.S. Pat. Nos. 4,248,146; 4,773,772 and 4,932,797. Other examples of printers with separate types of gap changing mechanisms can be seen in U.S. Pat. Nos. 4,210,076 and 4,780,007. A printer having a single sector or worm gear for adjusting the gap between a print head and platen is shown in U.S. Pat. No. 4,420,269. IBM Technical Disclosure Bulletin, Vol. 24, No. 11B, dated Apr. 1981, pp 6158 et seq. shows a adjustment mechanism for a platen and a print head which uses a stepped block or inclined plane for making the adjustment. Neither shows a single mechanism capable of performing fine and coarse gap changes.

SUMMARY OF THE INVENTION

According to the invention, the printer comprises first and second print mechanisms separated by a gap for the passage of a print medium. The gap adjustment mechanism includes single cam means having first and second camming surfaces capable of providing either fine or coarse gap changing While the cam means can take various forms, the preferred embodiment uses movable cam bars having first and second ramps where the first ramp has a gentle slope angle for producing fine gap changes and the second ramp has a steep slope angle for producing rapid or coarse gap changes. Thus form thickness adjustment and forms loading are combined into one gap changing mechanism. Also in the preferred embodiment, the first print mechanism is mounted on a stationary frame member and the second print mechanism is mounted on a movable frame member. The cam bars are slidably supported on the stationary frame. The camming ramps are formed as slots in the cam bars with one end of the second ramp being opened for receiving follower pins on the movable frame. Sliding motion of the cam bars is effected by rack and pinion gearing where the rack gearing is part of the cam bars and the pinion gearing is attached to a rotatable shaft supported on the stationary frame member. The cam bars are slidable within guide channels formed by guide blocks on the stationary frame member. The guide blocks have alignment slot openings with which the opening of the cam slot is aligned for receiving the follower pins of the movable frame. Spring means provides a counterbalancing and lifting force in opposition to the weight of the movable frame. The arrangement is both simple, easy to fabricate and operate and cost efficient.

The above and other advantages will become readily apparent from the detailed description of the invention as illustrated in the following drawings.

DETAILED DESCRIPTION OF THE INVENTION

Figure 1:
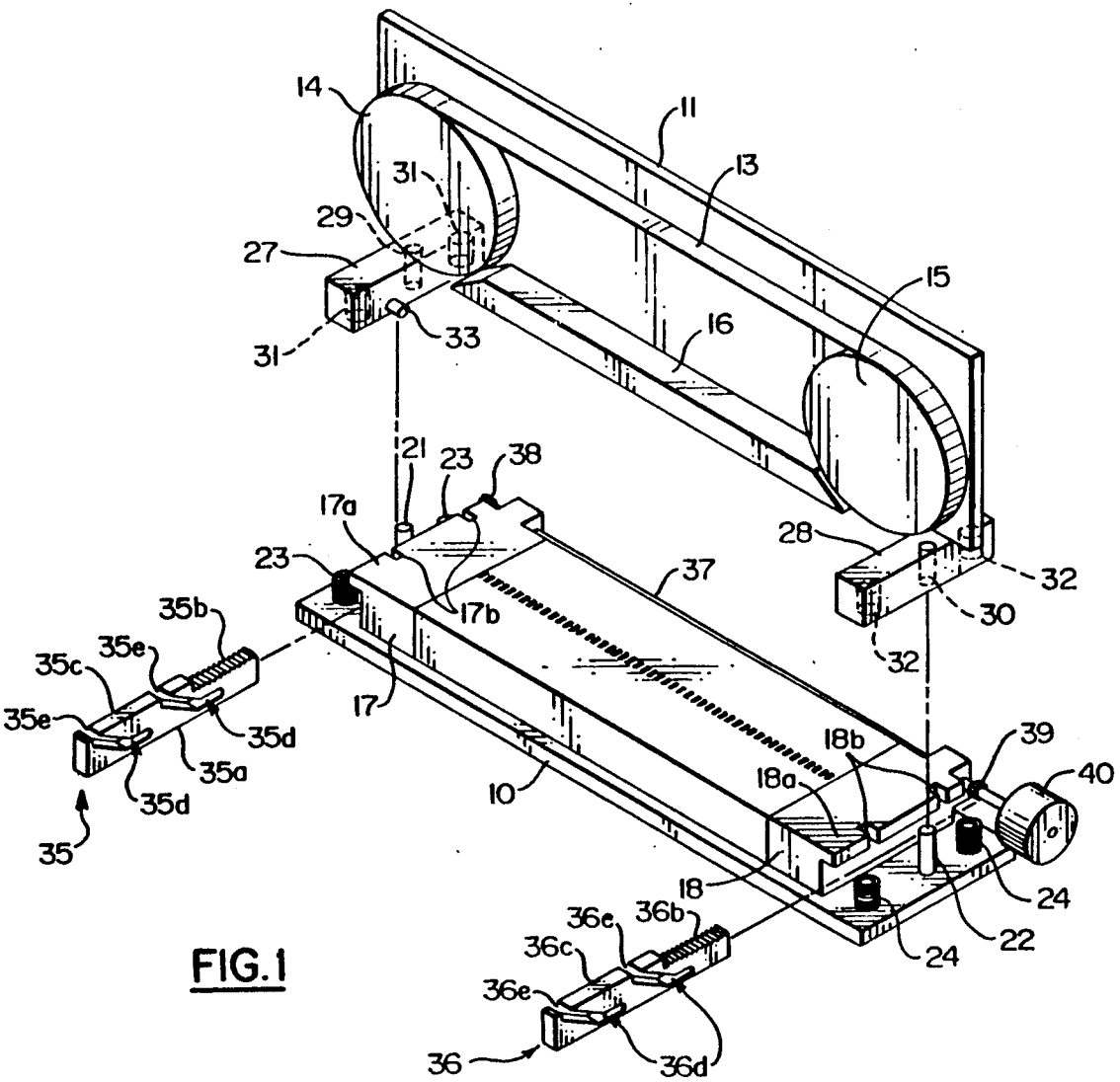
FIG. 1 is an exploded three dimensional view of a printer apparatus incorporating the invention.
Figure 2:
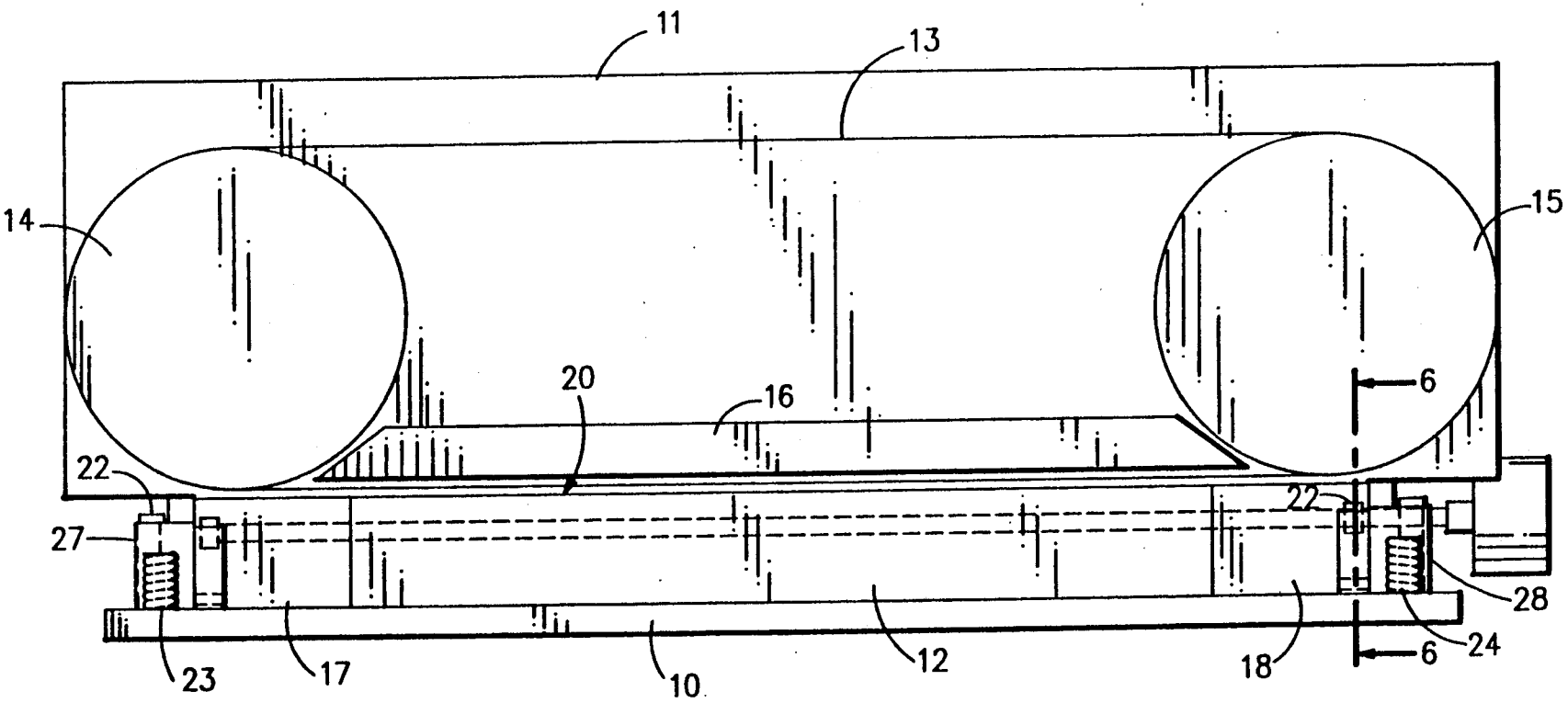
FIG. 2 is a front elevation of the printer apparatus of FIG. 1.

Referring to the drawings, first and second relatively movable frame members comprise horizontal base plate 10 and vertical plate 11 movably supported thereon. Cooperating print mechanisms comprise hammer unit 12 assembled onto base plate 10 and an endless type carrier band 13 with rotatable band drive pulleys 14 and 15 assembled onto vertical plate 11. Base plate 10 may be part of or attached to a printer frame structure which may also support paper guide and feed devices of any well known type such as forms feed tractors (not shown) operable for the purpose of controllably advancing a variable thickness print medium across the top surface of hammer unit 12. Affixed to vertical plate 11 between pulleys 14 and 15 is platen 16 which provides a backstop for a section of band 13. Also mounted on vertical plate 11 can be a rotary electric motor (not shown) connected to at least one of the pulleys and operable for revolving band 13 at substantially constant speed As is well known in the art, hammer unit 12 comprises a plurality of uniformly spaced hammer elements arranged in the row, each hammer element being individually actuated by means such as an electromagnet energized by electronic control circuitry in a manner well known in the art. Vertical plate 11 with the assembled print mechanisms thereon is mounted onto base plate 10 in a manner whereby type band 13 is aligned with and separated from hammer unit 12 by a gap 20 which forms a passageway for a print medium having variable thicknesses. As previously mentioned, the print medium can be a continuous web having either single or multiple layers whereby printing can be in the form of either a single or multiple copies.

Fixed to base plate 10 at either end of hammer unit 12 are guide blocks 17 and 18 having outwardly extending channel walls 17*a* and 18*a*. Together with the top surface of horizontal plate 10 channel walls 17*a* and 18*a* form guide channels for a purpose to be more fully explained. Vertical slots 17*b* and 18*b* are formed in the outward edges of walls 17*a* and 18*a*. Outside guide blocks 17 and 18 are vertical locating posts 21 and 22 positioned between pairs of coil springs 23 and 24, all being fixedly attached to and extending vertically upward from the plate member 10. Posts 21 and 22, the coil springs 23 and 24 and the vertical slots 17*b* and 18*b* coact to position and align the vertical plate 11 and the print mechanism assembled thereon so that type band 13 may be maintained in alignment with hammer unit 12.

Attached to the lower edge and near the opposite ends of vertical plate 11 are parallel horizontal arms or brackets 27 and 28. The arms 27 and 28 are fabricated with guide holes 29 and 30 located between pairs of countersunk holes 31 and 32. Extending inwardly from arms 27 and 28 toward the center of vertical plate 11 are follower pins 33 and 34. When vertical plate 11 is assembled onto base plate 10, vertical locating posts 21 and 22 are within the guide holes 29 and 30, coils springs 23 and 24 are within countersunk holes 31 and 32 and follower pins 33 and 34 are then in position for alignment within vertical slots 17*b* and 18*b* of channel walls 17*a* and 18*a* of guide blocks 17 and 18. Due to the weight of the vertical plate 11 and its assembled parts, coil springs 23 and 24 are spring loaded to the degree dependent on their spring rate. In the preferred embodiment in which the invention is practiced, the coil springs 23 and 24 have a spring rate which, when compressed by the vertical plate 11 and print mechanism assembly, exert a spring force which essentially counterbalances the weight of the vertical plate 11 and assembly at the point where the follower pins 33 and 34 are either just slightly above or partially or wholly within edge slots 17*b* and 18*b* of the channel walls 17*a* and 17*b* of blocks 17 and 18. Thus a downward force applied manually, which can be of relatively small magnitude, is required to move follower pins 33 and 34 into and/or completely through edge slots 17*b* and 18*b* of walls 17*a* and 18*a* of guide blocks 17 and 18. In response to the additional compression of springs 23 and 24, a net lifting force is produced on vertical plate 11 and assembly. From this arrangement, it is readily appreciated that it would be a relatively easy matter to assemble and remove the vertical plate assembly from the base assembly when desirable.

As previously stated, the invention provides forms loading and forms thickness adjustment of paper gap 20 in one mechanism. In the preferred embodiment, the mechanism comprises a pair of horizontal cam bars 35 and 36 which are movable linearly along base plate 10 relative to the hammer unit 12 by a rack and pinion gear arrangement. As seen in the drawings, cam bars 35 and 36 are essentially long and thin and are of generally rectangular cross section. The cams bars 35 and 36 are located within guide channels formed by the channel walls 17*a* and 18*a* of guide blocks 17 and 18 with plate 10. The cam bars 35 and 36 have a vertical dimension slightly less than the vertical dimension of the guide channel. A shaft 37 is journaled between the guide blocks 17 and 18 and pinion gears 38 and 39 are attached at spaced apart positions on shaft 37. The pinion gears 38 and 39 engage rack gears 35*b* and 36*b* formed in the top edges 35*c* and 36*c* of bars 35 and 36. Horizontal linear movement is imparted to cam bars 35 and 36 by rotation of shaft 37. A knob 40 attached to one end of shaft 37 enables the cam bars 35 and 36 to be moved manually in either direction. The ratio of the rack gears 35*b* and 36*b* and pinions 38 and 39 is such that a unit of rotation of the pinions produces a predetermined proportional amount of translatory movement of cam bars 35 and 36.

Figure 6:
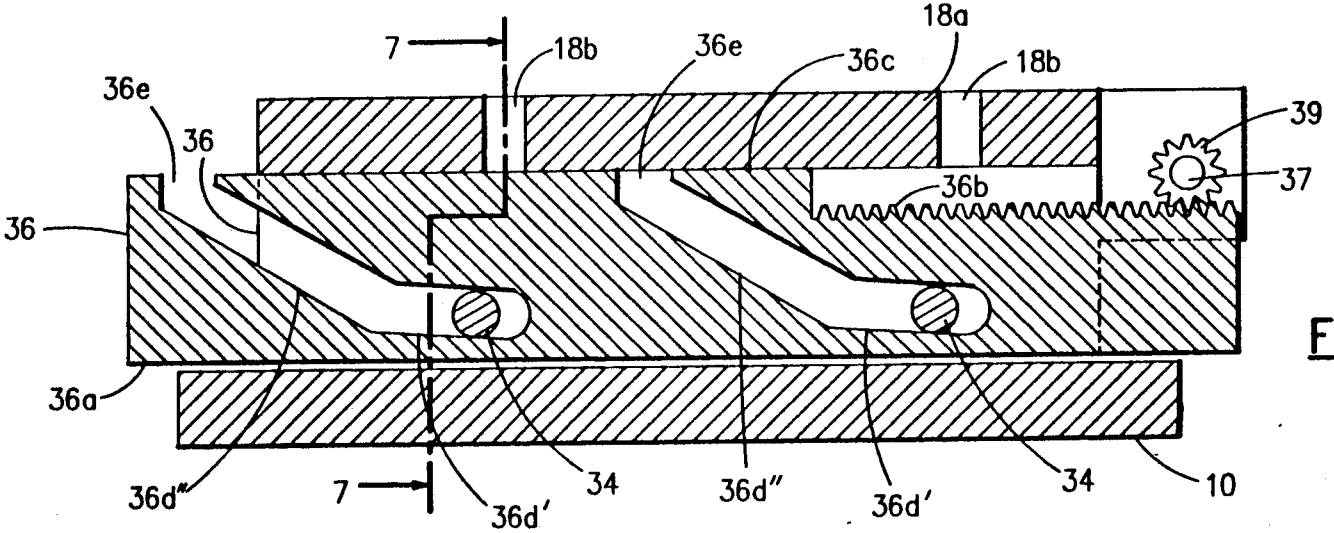
FIG. 6 is a sectional view taken along line 6—6 in FIG. 2.
Figure 7:
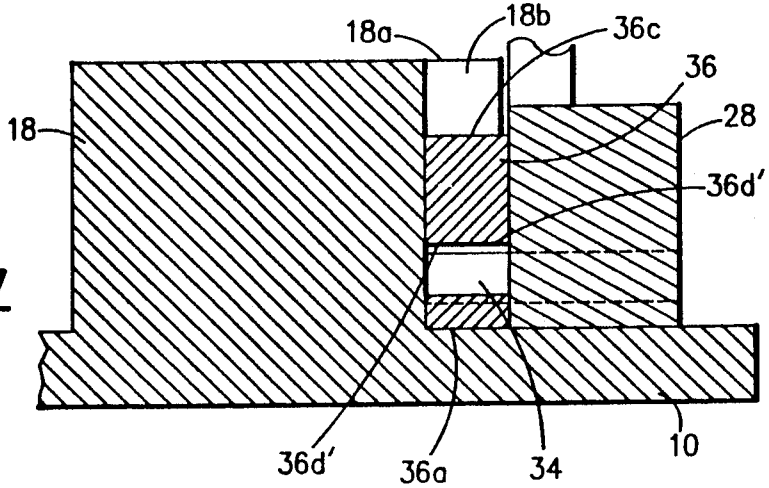
FIG. 7 is a sectional view taken along line 7—7 in FIG. 6.

Cam bars 35 and 36 are provided with camming means cooperable with follower pins 33 and 34 whereby translatory movement of cam bars 35 and 36 on base plate 10 resulting from bidirectional rotation of knob 40 produces corresponding vertical movement of vertical plate 11 to thereby obtain a controllable increase or decrease in the paper gap 20 between hammer unit 12 and type band 13. In the preferred embodiment in which the invention is practiced, the camming means of cam bars 35 and 36 takes the form of a pair of cam slots 35*d* and 36*d*. As best seen in FIG. 6, cam slots 36*d* have a lower cam section 36*d*′ which connects into an upper cam section 36*d*″ which terminates in a vertical entry slot 36*e* that opens at upper edge 36*c* of cam bar 36. Cam sections 36*d*′ and 36*d*″ are both linear ramps having different slope angles where the slope angle of section 36*d*′ is small compared to the slope angle of cam section 36*d*′ whereby cam section 36*d*′ is used for producing small or fine vertical displacements of plate 11 that accommodate forms thickness variations and the slope angle of cam section 36*d*″ is greater compared to the slope angle of cam section 36*d*′ whereby cam section 36*d*″ is used for making rapid or coarse vertical displacements of vertical plate 11 to accommodate loading of forms into paper gap 20. Similarly cam slots 35*d* in cam bar 35 have identical cam sections 34*d*′ and 35*d*″ terminating in a vertical entry slot 35*e* opening at the top edge 35*c* of cam bar 35. The relative slope angles of cam sections 34*d*′ and 35*d*″ match exactly the slope angles of cam sections 36*d*′ and 36*d*″. The magnitude of the slope angles of cam sections 35*d*′, 35*d*″, 36*d*″ and 36*d*″ depends on the amount of space available for the horizontal stroke of the cam bars 35 and 36. A suitable slope angle for cam sections 34*d*′ and 36*d*′ was 2 degrees and the length of those sections was 0.68 inches. The slope angle for 35*d*″ and 36*d*″ was 30 degrees and the length was 1.35 inches.

Figures 3, 4, 5:
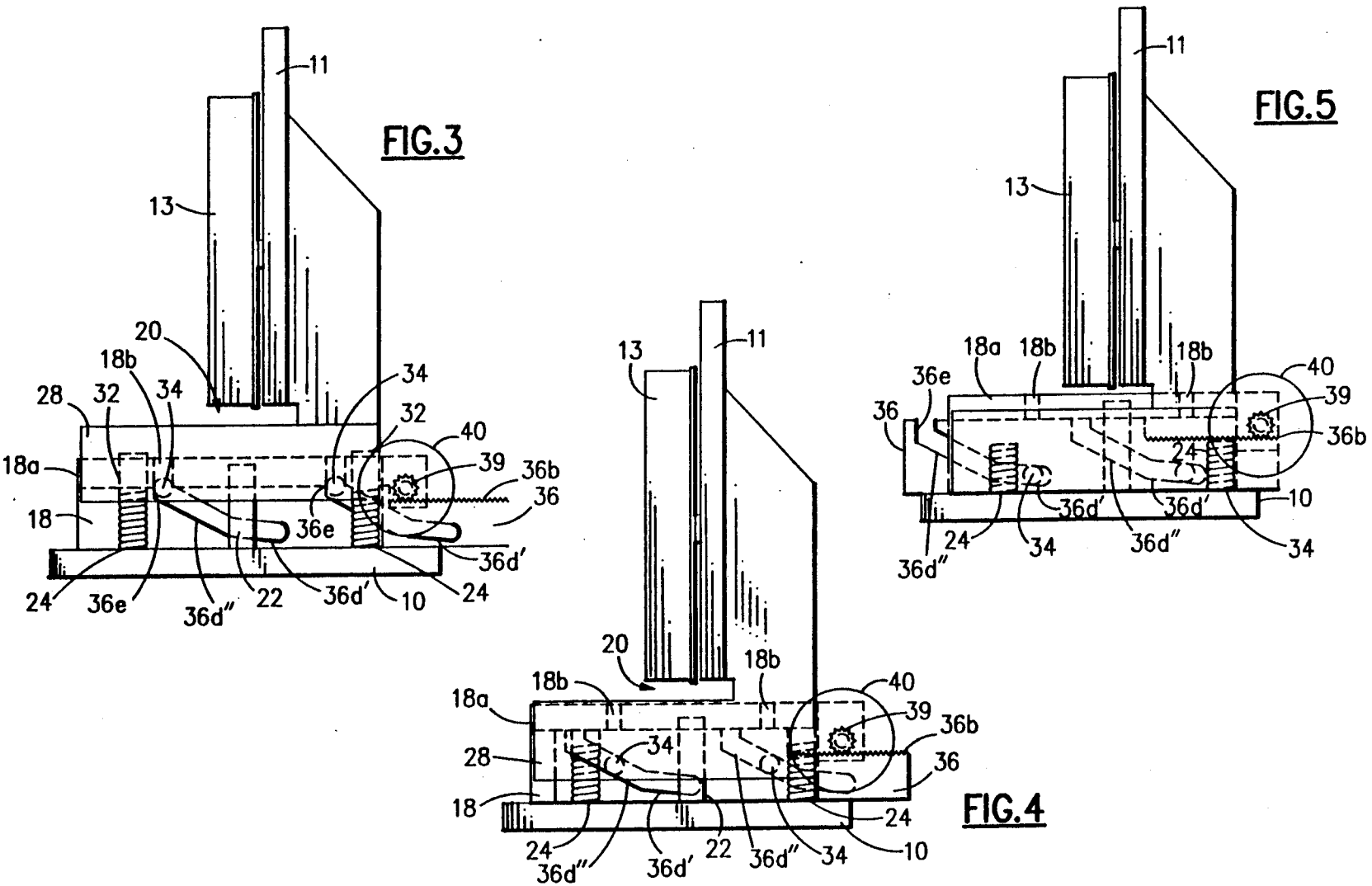
FIGS. 3–5 are side elevational views of the printer apparatus of FIGS. 1 and 2 showing three positions of the throat adjustment mechanism.

The operation of the gap adjustment mechanism can be seen by reference to FIGS. 3–5. As seen in FIG. 3, knob 40 has been rotated counterclockwise thereby translating cam bars 35 and 36 to the rightmost position so as to bring entry slots 35*e* and 36*e* of cam bars 35 and 36 into alignment with slots 17*b* and 18*b* of guide blocks 17 and 18 thus clearing the way for the introduction into or removal of follower pins 33 and 34 from the cam slots 35*d* and 36*d*. As previously noted, installation requires a downward force on vertical plate 11 to move the follower pins 33 and 34 completely through location slots 17*b* and 18*b* and into the entry slots 35*e* and 36*e* thus clearing cam bars 35 and 36 for horizontal translation on base plate 10 by clockwise rotation of knob 40.

In the position shown in FIG. 4, knob 40 has been rotated clockwise causing cam bars 35 and 36 to be translated horizontally to the left on base plate 10 and follower pins 33 and 34 have been cammed downwardly by cam sections 35*d*'' and 36*d*'' in opposition to the force of coil springs 23 and 24. Due to the net lifting force produced by springs 23 and 24 as a result of the camming action of sections 35*d*'' and 36*d*'', cam bars 35 and 36 are lifted so that the upper edges 35*c* and 36*c* of cam bars 35 and 36 will bear against the underside of channel walls 17*a* and 18*a* of guide blocks 17 and 18 and the bottom edges 35*a* and 36*a* are out of contact with the top surface of base plate 10. Over the range defined by cam sections 35*d*'' and 36*d*'', rotating knob 40 produces coarse adjustments in gap 20. In the position shown in FIG. 4, gap 20 is either open to or approaching the dimension at which forms loading may take place.

In the position shown in FIG. 5, knob 40 has been rotated clockwise until cam bars 35 and 36 have been translated to the leftmost position on base plate 10. Thus follower pins 33 and 34 have been cammed further down against the opposing force of springs 23 and 24 successively by cam sections 35*d*'' and 36*d*'' and then cam sections 34*d*' and 36*d*' thereby causing the vertical plate 11 and print mechanism assembly to move downward and causing gap 20 to be reduced. In the position shown in FIG. 5, knob 40 is rotatable counterclockwise and then clockwise as the case may be so that follower pins 33 and 34 are cammed by cam sections 35*d*' and 36*d*' for making fine adjustments to gap 20 to accommodate forms thickness variations. Graduated scale means (not shown) may be provided on base plate 10 for various settings of the knob 40 which can correspond to different thicknesses of forms. From the position shown in FIG. 5, knob is easily rotated counterclockwise bringing follower pins 33 and 34 into engagement with cam sections 35*d*'' and 36*d*'' as seen in FIG. 4 where coarse adjustments of gap 20 are produced for loading of forms or for movement to the position shown in FIG. 3 for removal of the vertical plate and band drive assembly if desired.

Thus it will be seen that an improved mechanism for adjusting paper gap in a printer has been provided which is simple in construction, easy to operate and assemble, and which provides both forms thickness adjustment and forms loading quickly and reliably with a single mechanism.

What is claimed is:

1. A printer apparatus comprising in combination a base portion and a frame portion movable relative to said base portion, a print hammer unit supported on said base portion of said apparatus, a type carrier supported on said frame portion and having a surface defining a gap with said print hammer unit for the passage of a print medium on which characters are printed, and a gap control means for adjusting the magnitude of said gap for various thicknesses of said medium or for the loading of said medium into said gap, said gap control means comprising camming means comprising at least one cam element movably supported on said base portion and follower means on said frame portion, said at least one cam element having a camming surface engageable by said follower means and having a first camming section with a first camming profile suitable for making fine adjustments and a second camming section with a second camming profile suitable for making coarse adjustments to said gap, and operator means for moving said at least one cam element to cause either said first or second camming sections to operatively engage said follower means to produce movement of said frame portion relative to said base portion for adjusting said gap to accommodate print media of different thicknesses or for loading a print medium into said gap.

2. A printer apparatus in accordance with claim 1 wherein said at least one cam element comprises cam bar means movable on said base portion, said cam bar means having said camming surface with said first and second camming sections, and said operator means includes rack and pinion means for moving said cam bar means on said base portion to produce said fine and coarse adjustments of said gap.

3. A printer apparatus in accordance with claim 2 wherein said operator means further comprises shaft means rotatable on said base portion, and said rack and pinion means comprises rack means on said at least one cam bar and pinion means on said rotatable shaft in operative engagement with said rack means to produce movement of said at least one cam bar on said base portion.

4. A printer apparatus in accordance with claim 1 wherein said at least one cam element comprises cam bar means movable in linear fashion on said base portion, and said first and second camming sections of said camming surface of said camming means engageable by said follower means comprise first and second linear camming sections on said cam bar means, said first linear camming section having a first linear camming profile suitable for making fine adjustments and said second linear camming section having a second linear camming profile suitable for making coarse adjustments to said gap.

5. A printer apparatus in accordance with claim 4 wherein said first and second linear camming sections comprise first and second linear ramps having first and second slope angles for producing said fine and coarse adjustments of said gap.

6. A printer apparatus in accordance with claim 4 which further comprises guide means on said base portion forming a guide channel for guiding the movement of said cam bar means on said base portion, and said camming means on said cam bar means comprises camming slot means with said first and second camming sections, said cam bar means having an opening providing entry into said camming slots, said guide channel having alignment slots for aligning said follower means with the said opening in said cam bar means, and said cam bar is movable by said operator means for aligning said opening in said cam bar means with said alignment slots of said guide channel for receiving said follower means into said cam slots.

7. A printer apparatus in accordance with claim 6 wherein said opening on said cam bar means provides entry into said camming section of said camming slots of said bar means suitable for making coarse adjustments to said gap.

8. A printer apparatus in accordance with claim 6 wherein said guide means includes a channel wall spaced from and forming said guide channel with said base portion for said cam bar means with said alignment slots being formed in said channel wall, and which further comprises spring means loaded for applying a bias force to said follower means for maintaining said cam bar means in engagement with said channel wall during movement of said cam bar means by said operator means on said base portion.

9. A printer apparatus in accordance with claim 4 in which said base portion includes a horizontal plate member and said frame portion is movable vertically relative to said base plate member, said cam bar means comprises a pair of spaced cam bars movable by said operator longitudinally on said horizontal plate member, and said cam bars each having said first and second linear camming sections cooperable with said follower means for producing fine and coarse vertical adjustments of said frame portion in response to longitudinal movement of said cam bars by said operator means.

10. In a printer apparatus having in combination, first and second relatively movable frame members, first and second cooperating print elements supported respectively on said first and second frame members, said print elements being separated by a gap which defines a passageway for print media on which printing is produced, and gap control means including cam means operable to effect relative movement of said first and second frame members to cause changes in the magnitude of said gap, said cam means having a first camming surface which effects relative movement of said frame members for making fine adjustments in the magnitude of said gap at a first rate which corresponds to variations in the thickness of said media and a second camming surface extending from said first camming surface which effects relative movement of said frame members at a second rate which rapidly enlarges the magnitude of said gap for insertion or removal of said print media from said gap.

11. In a printer apparatus having in combination, first and second cooperating print elements, said print elements being arranged to form a gap for the passage of print media therebetween, and gap changing means including cam means operable to effect relative movement of said first and second print elements to vary the magnitude of said gap, said cam means having a first camming surface to effect fine adjustments of said gap corresponding with varying thicknesses of print media fed through said gap for printing thereon and a second camming surface connected with said first camming surface to effect coarse adjustments of said gap to facilitate insertion or removal of print media of varying thicknesses from said gap.

12. In a printer apparatus having in combination, first and second cooperating print elements, said print elements being arranged for relative movement and to form a gap for receiving print media therebetween, and gap changing means including cam means and a single operator therefor, said cam means having a first camming section suitable for effecting said relative movement of said first and second print elements to provide fine adjustment of said gap to accommodate varying thicknesses of said media, and and a second camming section suitable for effecting said relative movement of said first and second print elements to provide coarse adjustment of said gap to facilitate insertion or removal of print media of varying thicknesses from said gap.

13. In a printer apparatus having the combination in accordance with claim 12 wherein said cam means comprises a pair of spaced cam bars, said first and second camming sections comprise first and second linear camming ramps on each of said camming bars, and said single operator means comprises rack gearing on each of said cam bars, pinion gearing cooperable with said rack gearing means, and means for rotating said pinion means to effect longitudinal movement of said cam bars including a rotatable shaft for supporting said pinion gearing in engagement with said rack gearing and knob means for rotating said shaft.

* * * * *